US006109908A

United States Patent [19]

Ikehara et al.

[11] Patent Number: 6,109,908

[45] Date of Patent: Aug. 29, 2000

[54] APPARATUS FOR MOLDING A SLIDER COVER

[75] Inventors: Hideshi Ikehara; Ryoji Kawamura, both of Toyama-ken, Japan

[73] Assignee: YKK Corporation, Tokyo, Japan

[21] Appl. No.: 09/154,475

[22] Filed: Sep. 16, 1998

Related U.S. Application Data

[62] Division of application No. 08/848,612, Apr. 29, 1997, Pat. No. 5,848,455.

[30] Foreign Application Priority Data

Apr. 30, 1996 [JP] Japan ..... 8-109550

[51] Int. Cl.[7] ..... B29C 45/44

[52] U.S. Cl. ..... 425/545; 425/556; 425/577; 425/DIG. 58

[58] Field of Search ..... 425/545, 556, 425/577, DIG. 58

[56] References Cited

U.S. PATENT DOCUMENTS

| | | | |
|---|---|---|---|
| 2,222,529 | 11/1940 | Dahlin . | |
| 3,813,736 | 6/1974 | Fukuroi . | |
| 4,048,699 | 9/1977 | Kanzaka . | |
| 4,123,828 | 11/1978 | Akashi . | |
| 4,287,646 | 9/1981 | Kanzaka . | |
| 4,667,376 | 5/1987 | Ishii et al. . | |
| 4,695,421 | 9/1987 | Takeda | 425/DIG. 58 |
| 5,079,820 | 1/1992 | Mayerhofer | 425/545 |
| 5,403,179 | 4/1995 | Ramsey | 425/577 |
| 5,419,019 | 5/1995 | Ida . | |
| 5,604,962 | 2/1997 | Mayerhofer . | |
| 5,698,243 | 12/1997 | Wakabayashi | 425/545 |

FOREIGN PATENT DOCUMENTS

| | | |
|---|---|---|
| 0 204 186 A1 | 12/1986 | European Pat. Off. . |
| 0 604 695 A1 | 7/1994 | European Pat. Off. . |
| 0 612 486 A1 | 8/1994 | European Pat. Off. . |
| 2125479 | 9/1972 | France . |
| 2 471 955 | 9/1979 | France . |
| 2 011 994 | 7/1979 | United Kingdom . |

*Primary Examiner*—Tim Heitbrink
*Attorney, Agent, or Firm*—Hill & Simpson

[57] ABSTRACT

In an auto-lock slide fastener slider composed of four members, i.e., a slider body, a pull tab, a locking and a cover, the slider body has front and rear resilient cover-attachment projections extending from an upper wing and terminating respectively in outwardly directed hooks while the cover is made of thermoplastic resin and has on respective inner edges of front and rear end walls corresponding inwardly directed hook portions resiliently engaged with the hooks of the cover-attachment projections. The cover can be attached to the slider body simply in a single snap action. Since all parts of the attaching mechanism are concealed by the cover, the resulting slider is neat in appearance.

3 Claims, 13 Drawing Sheets

APPARATUS FOR MOLDING A SLIDER COVER

This is a divisional of application Ser. No. 08/848,612, filed Apr. 29, 1997 now U.S. Pat. No. 5,848,455.

BACKGROUND OF THE INVENTION

1. Field of the Invention

This invention relates to an auto-lock slide fastener slider composed of a slider body, a pull tab, and a combination of a resilient locking member with a resilient tongue and a cover, which may be substituted by a combination of a mere rigid locking member and a leaf spring disposed between the cover and the rigid locking member, at least the slider body and the cover being made of thermoplastic resin. The invention relates also to an apparatus for molding the cover by injection.

2. Description of the Related Art

In conventional auto-look slide fastener sliders of the described type, for attaching a cover to a slider body, it is known to clench the cover against front and rear cover-attachment lugs of the slider body if both the slider body and the cover are made of metal and also to weld the cover and the slider body together by high-frequency or ultrasonic welding if both the slider body and the cover are made of thermoplastic resin.

In an alternative conventional form, as shown in FIG. 20 of the accompanying drawings, a slider body 1' has front and rear cover-attachment projections 12' extending from the upper wing 7' and terminating respectively in outwardly directed hooks 13', the front cover-attachment projection 12' of which is integral with a pair of pivot supporting portions 15' for supporting a pivot 23' horizontally provided to a locking member, an engaging recess 14' between the pivot supporting portions, and a locking-pawl-insertion hole 16' near a base of the rear cover-attachment projection 12'. And a locking member 3' has a locking pawl 26' at one end which is retractably inserted through the locking-pawl-insertion hole, an engaging leg 22' at the other end which is inserted in the engaging recess, the pair of horizontal pivot pins 23' disposed on its opposite side surfaces toward the front cover-attachment projection 12', and a resilient tongue 24' obliquely projecting from its upper surface. On the other hand, a cover 4' has in front and rear end walls a pair of engaging through-holes in which the front and rear cover-attachment projections 12' are engaged. In assembling, an axle 20' of a pull tab 2' is placed on the upper wing 7' of the slider body 1' between the locking-pawl-insertion hole 16' and the pivot supporting portions 15', and then the locking member 3' is mounted astride of the axle 20' of the pull tab 2', with the locking pawl 26' inserted in the locking-pawl-insertion hole 16' and with the engaging leg 22' received in the recess 14', whereupon the cover 4' is attached to the upper wing 7' by engaging the hooks 13' with the engaging through-holes so as to conceal the locking member 3'. This conventional slide fastener slider is disclosed in Republic of China Patent Publication No. 248646.

In the first-named slider in which the cover is attached to the slider body 1' by clenching or welding, since the clenching step or the welding step must be added to the automatic assembling process, it is impossible to realize a high-speed automatic assembling process and hence production rate can not be improve particularly in the case of thermoplastic resin slider.

In the case of the slider shown in FIG. 20, since the front and rear cover-attachment projections 12' on the upper wing 7' of the slider body 1' engage in the engaging through-holes of the cover 4', the projections can be seen to make the appearance of the slider unsightly, deteriorating the commercial value of the product. Further, since the slider body 1' has on the upper wing 7' no guide for the axle 20' of the pull tab 2', it is impossible to guide the axle 20' of the pull tab 2' reliably and smoothly, thus causing non-stable operation of the pull tab 2'.

SUMMARY OF THE INVENTION

With the foregoing prior art problems in view, it is a first object of this invention to provide an auto-lock slide fastener slider which enables to attach a thermoplastic resin cover to a thermoplastic resin slider body firmly and stably in a simple smooth snap action without rattling during use, to facilitate assembling the slider and to give a neat appearance.

A second object of the invention is to provide a four-member auto-lock slide fastener slider composed of a slider body, a pull tab, a cover and a locking member having a resilient tongue integral with the locking member which four members can be assembled together precisely and/or firmly, securing an automatic locking function reliably and smoothly.

A third object of the invention is to provide an reinforced cover, for an auto-lock slide fastener slider, which is suitable for use with a thermoplastic locking having a resilient tongue integral with the locking member.

A fourth object of the invention is to provide a five-member auto-lock slide fastener slider composed of a slider body, a pull tab, a locking n a leaf spring and a cover, which five members can be assembled together precisely and/or firmly, securing an automatic locking function reliably and smoothly.

A fifth object of the invention is to provide a cover, for the five-member auto-lock slide fastener slider described in connection with the fourth object, in which the cover is suitable for use to attach a leaf spring of metal, matching the shape of the leaf spring.

A sixth object of the invention is to provide a double-sided auto-lock slide fastener slider having pull tabs on both sides of the slider body, which can be assembled simply and stably, can secure a reliably automatic locking function and has a neat appearance.

A seventh object of the invention is to provide an apparatus for molding a thermoplastic cover, which has a neat appearance and is suitable for the auto-lock slide fastener slider, in which a thermoplastic slider body and cover can be assembled readily and smoothly so that the assembling process of the slider can be simplified and hence its productivity can be improved, simply and reliably by injection molding.

An eighth object of the invention is to provide an apparatus for molding a cover, which facilitates mounting a locking member and/or a leaf spring and is suitable for use in the four-mere and five-member auto-lock slide fastener sliders described in connection with the foregoing objects, by injection molding using slide cores.

According to a first aspect of the invention, the primary object is accomplished by an auto-lock slide fastener slider comprising: a thermoplastic resin slider body composed of upper and lower wings; front and rear resilient cover-attachment projections extending from an upper surface of the upper wing and terminating respectively in outwardly directed hooks; a locking member supported on the upper surface of the upper wing so as to be pivotally movable; a thermoplastic resin box-shape cover covering the locking m and having on respective inner edges of front and rear end walls corresponding inwardly directed hooks resiliently engaged with the outwardly directed hook portions of the front and rear resilient over-attachment projections, the cover also having in opposite side walls a pair of axle-insertion holes; and a pull tab having an axle which is inserted through the axle-insertion holes and is operatively connected with the locking member so as to bring the locking member from a locked position to an unlocked position.

According to a second aspect of the invention, the second object is accomplished by an auto-lock slide fastener slider wherein the upper wing has an engaging recess near a base of the front resilient cover-attachment projection, a locking-pawl-insertion hole near a base of the rear resilient cover-attachment projection, a pair of pivot supporting portions disposed on opposite sides of the engaging recess and a pair of axle guide portions, which is disposed between the engaging recess and the locking-pawl-insertion hole and has confronting inclined guide surfaces for guiding the axle of the pull tab, the locking member having a locking pawl at one end for insertion through the locking-pawl-insertion hole, an engaging leg at the other end for engagement with the engaging recess, a pair of transverse pivots disposed on opposite side surfaces at an intermediate position toward the engaging leg and supported by the pivot supporting portions, for attaching the cover from the above, and a resilient tongue projecting obliquely from an upper edge of the locking m and resiliently touching a ceiling of the cover so as to normally urge the locking member.

According to a third aspect of the invention, the third object is accomplished by an auto-lock slide fastener slider wherein the cover has a pair of reinforcing protuberances bulging inwardly from the side walls for reinforcing the cover and for pressing the pivots of the locking member against the pivot support portions.

According to a fourth aspect of the invention, the fourth object is accomplished by an auto-lock slide fastener slider further including a leaf spring which is supported at opposite ends by the front and rear resilient cover-attachment projections and is clamped at each of the opposite ends between the respective cover-attachment projections and the cover, the upper wing having an engaging recess near a base of the front resilient cover-attachment projection, a locking-pawl-insertion hole near a base of the rear resilient cover-attachment projection, and a pair of axle guide portions. Which is disposed between the engaging recess and the locking-pawl-insertion hole and has confronting inclined guide surfaces for guiding the axle of the pull tab, with the axle being placed between the axle guide portions, the locking member having a locking pawl at one end for insertion through the locking-pawl-insertion hole and an engaging leg disposed at the other end for engagement with the engaging recess, the locking being normally urged to the locked position by the resilience of the leaf spring.

According to a fifth aspect of the invention, the fifth object is accomplished by an auto-lock slide fastener slider wherein each of the front and rear resilient cover-attachment projections has an irregular top surface, the leaf spring having on each of the opposite ends an irregular surface complementing the irregular top surface, the cover having on each of front and rear ends of the ceiling a leaf-spring-holding protuberance for holding the irregular surface on the irregular top surface.

According to a sixth aspect of the invention, the sixth object is accomplished by an auto-lock slide fastener slider wherein the slider is a double-sided type having additional front and rear resilient cover-attachment projections identical in structure with the front and rear resilient cover-attachment projections on the upper wing and disposed on a lower surface of the lower wing, an additional cover identical in structure with the first-named cover and attached to the lower wing, an additional pull tab identical in structure with the first-named pull tab, and a link pivotally mounted on the lower wing and operatively connected with the additional pull tab and the locking member for transmitting the action of the additional pull tab to the locking m the hook portions of the additional cover being engaged with the corresponding hooks of the additional cover-attachment projections.

According to a seventh aspect of the invention , the seventh object is accomplished by an apparatus for molding a cover of an auto-lock slide fastener slider, comprising: a fixed die; a movable die; a sliding template, a pair of converging cams, a pair of slide cores, a tapered core, and an eject pin. In the apparatus, the sliding template has a cover-forming cavity and resiliently projectable from the movable or fixed die, the pair of converging cams are fixed to the movable or fixed die and projecting at opposite sides of the sliding template, the pair of slide cores are laterally slidably received between the cams, each of the slide cores having in its upper outer surface an undercut recess, confronting surfaces of the slide cores being tapered. And the tapered core is fixed to the fixed or movable die between the confronting surfaces of the slide cores, and the eject pin is disposed centrally of the tapered core and projectable from the tapered core.

According to an eighth aspect of the invention, the eighth object is accomplished by a molding apparatus wherein each of cover molding portions of the slide cores has on its upper side surface a stepped portion for forming reinforcing-protuberances so as to hold pivots, the tapered core having at its distal end an axle-insertion-hole-forming projection.

According to a ninth aspect of the invention, the eighth object is accomplished by an alternative molding apparatus wherein each of the cover molding portions of the slide cores has in its upper surface a recess for forming a leaf-spring-holding protuberance so as to hold a leaf-spring, the tapered core having at its distal end an axle-insertion-hole-forming projection.

DETAILED DESCRIPTION OF THE PREFERRED EMBODIMENTS

Embodiments of an auto-lock slide fastener slider according to this invention will now be described in detail with reference to the accompanying drawings.

Figure 1:
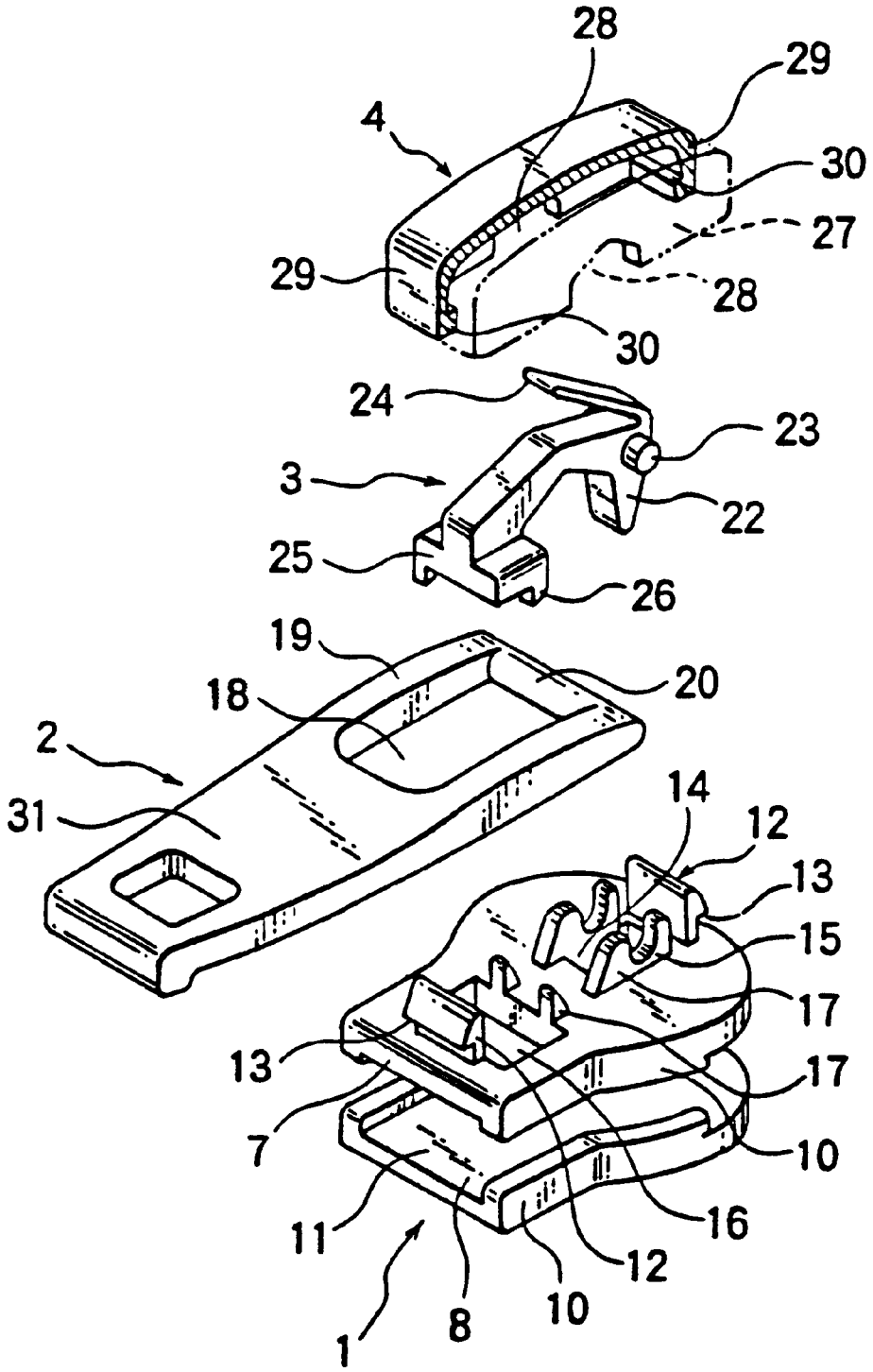
FIG. 1 is an exploded perspective view, with parts broken away, of an auto-lock slide fastener slider according to a first embodiment of this invention.
Figure 5:
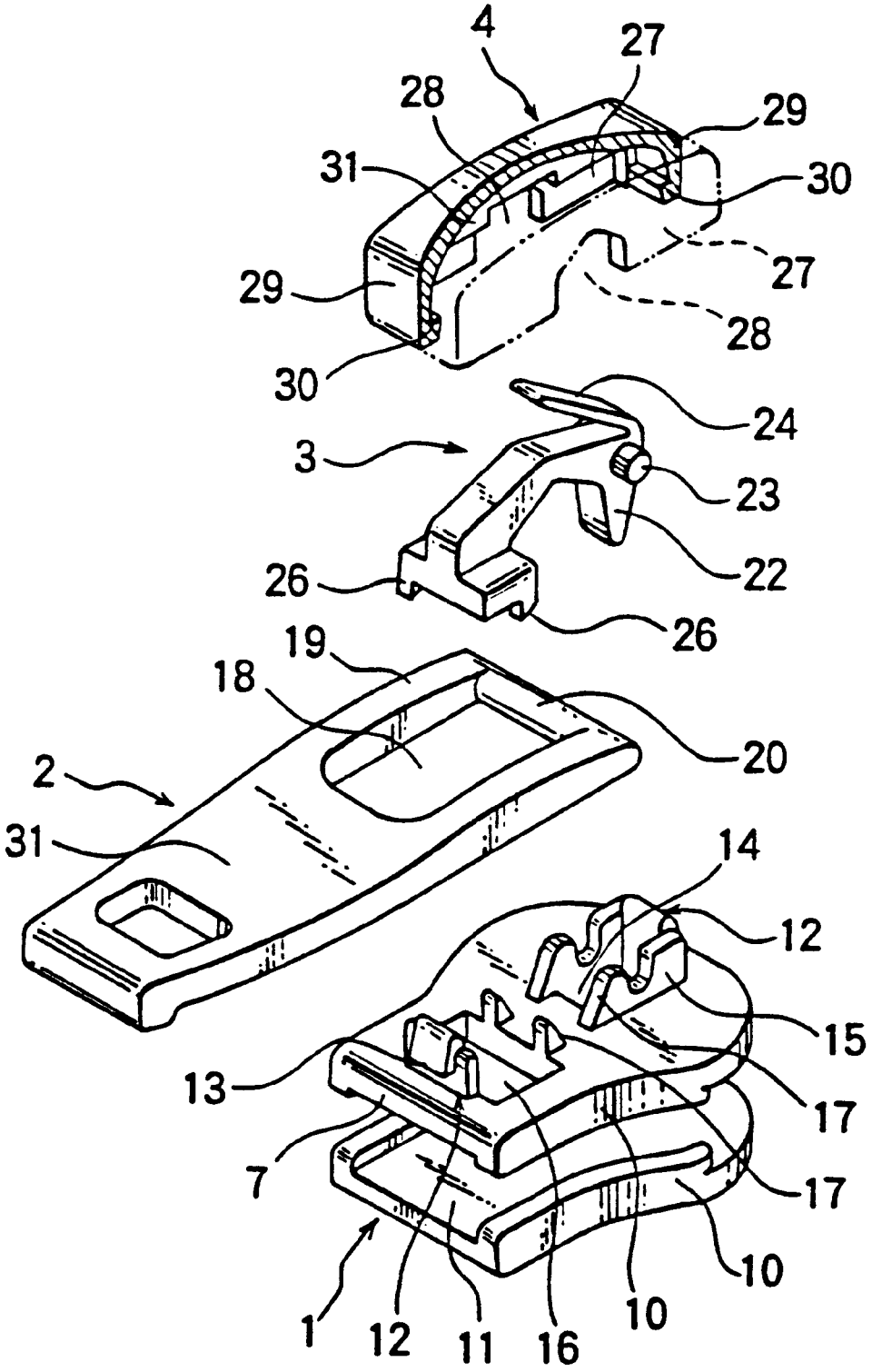
FIG. 5 is an exploded perspective view, with parts broken away, of another auto-lock slide fastener slider according to a second embodiment of the invention.
Figure 6:
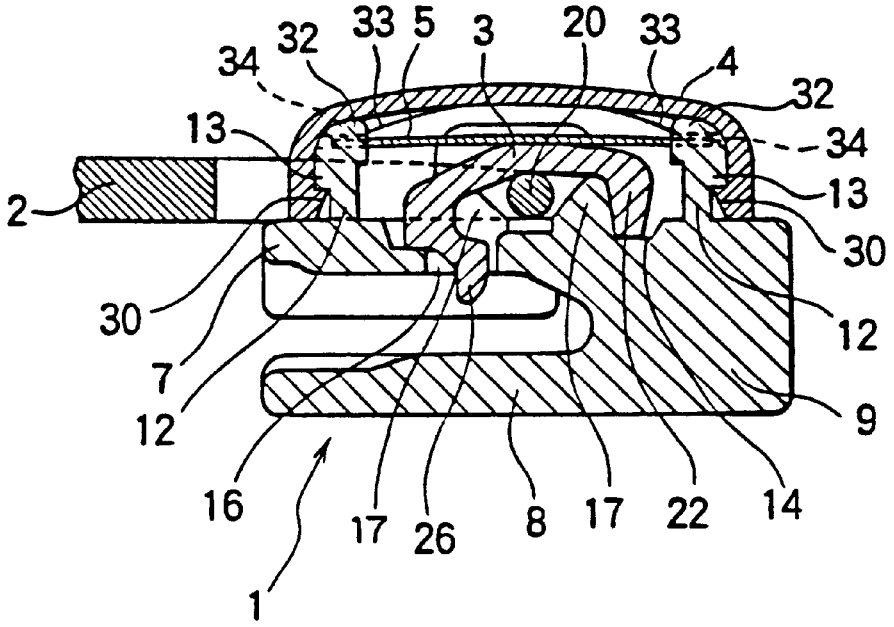
FIG. 6 is a fragmentary longitudinal cross-sectional view of the slider of the third embodiment.
Figure 10:
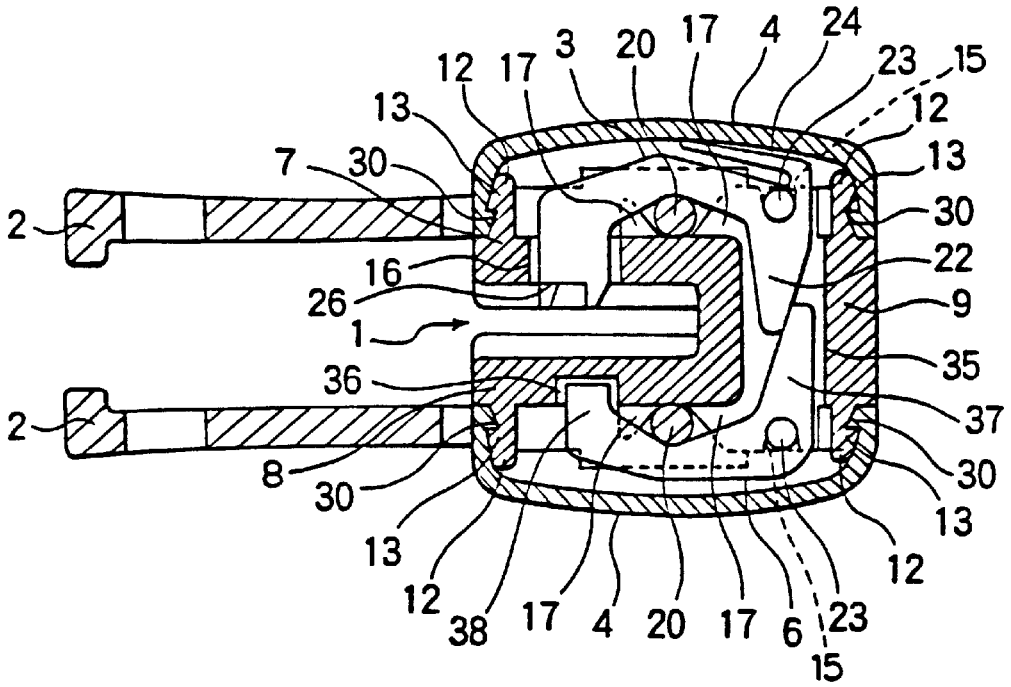
FIG. 10 is a longitudinal cross-sectional view of a double-sided auto-lock slide fastener slider according to a fourth embodiment of the invention.
Figure 11:
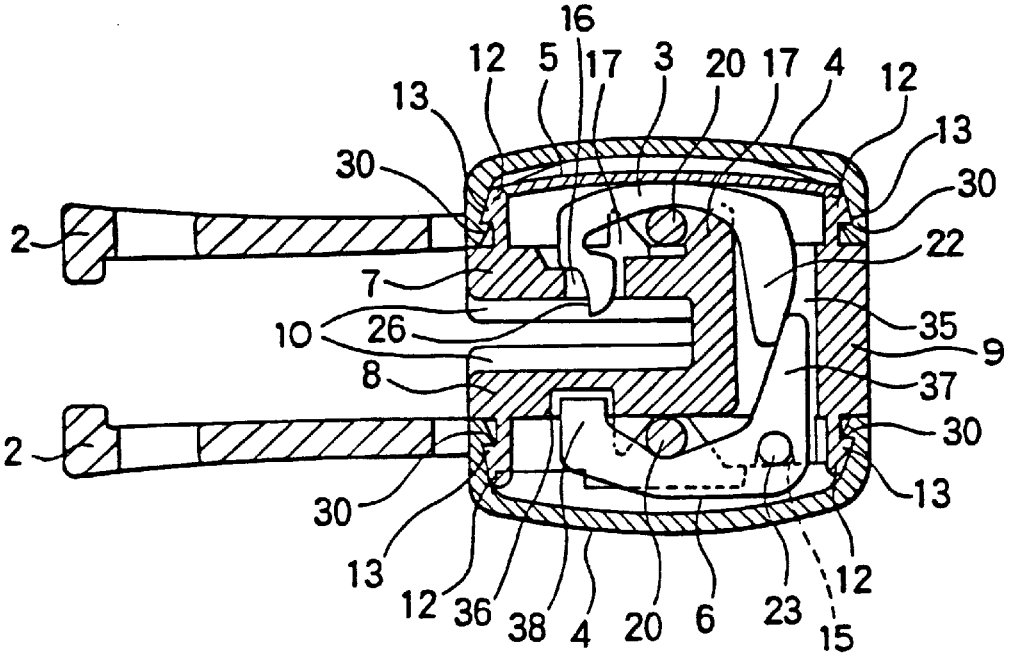
FIG. 11 is a longitudinal cross-sectional view of another double-sided auto-lock slide fastener slider according to a fifth embodiment of the invention.

The auto-lock slide fastener slider of this invention is a four-member slider, which is composed of a slider body 1, a pull tab 2, a locking member 3 and a cover 4 as shown in FIGS. 1 and 5, or a five-member slider, which is composed of a slider body 1, a pull tab 2, a locking member 3, a leaf spring 5 and a cover 4 as shown in FIG. 6. The slider may be a double-sided slider, which is composed of a slider body 1, first and second pull tabs 2, a locking member 3, a cover 4, and a link 6, as shown in FIG. 10, or a double-sided slider which is composed of a slider body 1, pull tabs 2, a locking member 3, a leaf spring 5, a link 6, and a cover 4, the link 6 being operatively connected with the locking member 3, as shown in FIG. 11.

In any of these sliders, at least the slider body 1 and the cover 4 are molded of thermoplastic resin, while the pill tab 2, the locking member 3 and the link 6 may be made of thermoplastic resin or metal, the leaf spring 5 being made of metal. The thermoplastic resin is synthetic resin, such as polyamide, polyacetal, polypropylene and polybutylene terephthalate; using such synthetic resin, the slider body 1, the cover 4, the pull tab 2, the locking member 3 and the link 6 are molded by injection.

Figure 2:
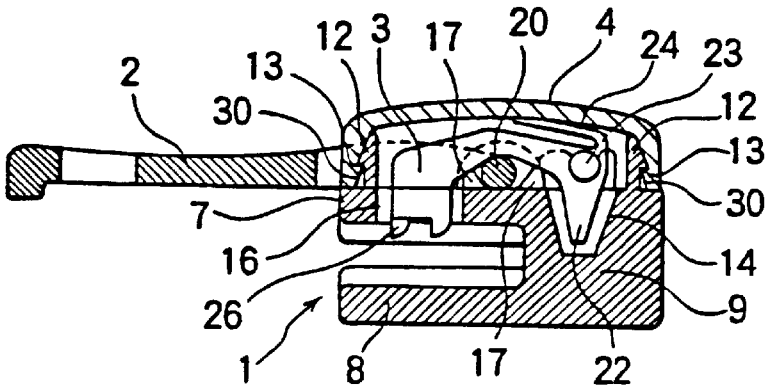
FIG. 2 is a longitudinal cross-sectional view of the slider of the first embodiment.

In the auto-lock slide fastener slider of FIGS. 1 and 2, the slider body 1 is formed with upper and lower wings 7, 8 joined at their front ends by a coupling-element guide post 9, each of the upper and lower wings 7, 8 having a pair of guide flanges 10 along opposite side edges to define a generally Y-shape coupling-element guide channel 11 between the upper and lower wings 7, 8.

The upper wing 7 has front and rear resilient cover-attachment projections 12 extending from its upper surface and terminating in a pair of outwardly directed hooks 13, respectively, so that the top of the cover-attachment projection 12 can be fitted in the cover 4 in a manner described below.

Further, the upper wing 7 has an engaging recess 14 near the base of the front cover-attachment projection 12 and in the guide post 9, a pair of pivot supporting portions 15 disposed on opposite sides of the engaging recess 14 and projecting upwardly with their upper surfaces being concave. And a rectangular locking-pawl-insertion hole 16 is provided near the base of the rear cover-attachment projection 12, and front and rear parallel axle guide portions 17, which are disposed between the engaging recess 14 and the locking-pawl-insertion hole 16 and have confronting inclined guide surfaces. The front axle guide portion 17 is formed integrally with the pivot supporting portions 15.

The pull tab 2 is in the form of a generally rectangular plate having at one end a rectangular through-hole 18 to form a ring-shape end portion 19 and an axle 20, and at the other end a grip portion 21. The through-hole 18 has a width substantially equal to the width of the cover 4, and the axle 20 is to be placed between the front and rear axle guide portions 17 on the upper wing 7.

The locking member 3 is in the form of a generally C-shape plate having at one end a front downwardly directed engaging leg 22 to be fitted in the engaging recess 14 and at its rear end a locking pawl 26 downwardly projecting front a rear leg 25. The locking pawl 26 is a double for so as to be inserted and to engage a pair of rows of coupling elements. Also the locking member 3 has a pair of transverse pivots 23 projecting in opposite directions from the respective side surfaces of the C-shape plate at a position toward the engaging leg 22, and an inwardly inclined resilient tongue 24 projecting from an upper edge of the C-shape plate at a position above the pivots 23.

Figure 3:
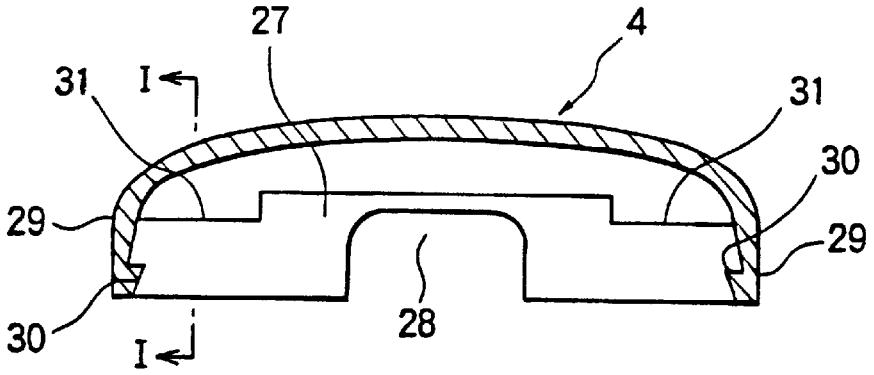
FIG. 3 is an enlarged longitudinal cross-sectional view of a cover of the slider of the first embodiment.
Figure 4:
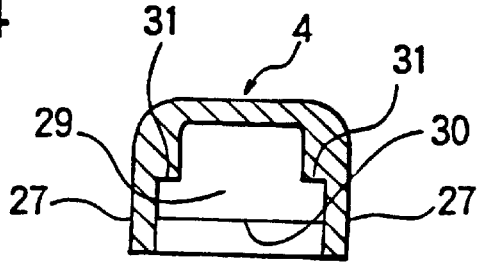
FIG. 4 is a transverse cross-sectional view taken along line of I—I of FIG. 3.

The cover 4 is in the form of an elongated bottomless box having a pair of axle-insertion holes 28 centrally in its opposite side walls 27 in which the axle 20 is to be inserted and a pair of projecting hook portions 30 at the respective lower inner edges of front and rear end walls 29 along their entire width, the hook portions 30 being engageable with the corresponding hooks 13 of the front and rear cover-attachment projections 12. Also the cover 4 has a pair of reinforcing protuberances 31 bulging inwardly from the opposite side walls 27 along their upper corners, as shown in FIGS. 3 and 4, for reinforcing the cover 4 and for pressing the pivots 23 of the locking member 3 to prevent the pivots 23 front being removed off the pivot supporting portions 15.

For assembly, the pull tab 2 is placed flat on the upper wing 7 of the slider body 1 with the axle 20 supported between the front and rear axle guide portions 17 on the upper wing 7, and the locking member 3 is mounted astride of the axle 20 with the locking pawl 26 projecting into the coupling-element guide channel 11 from the locking-pawl-insertion hole 16, with the engaging leg 22 received in the engaging recess 14 and also with the pivots 23 supported on the pivot supporting portions 15, whereupon the cover 4 is pressed against the upper wing 7 of the slider body 1 so that the hooks 13 of the front and rear cover-attachment projections 12 resiliently engage with the hook portions 30 of the cover 4 in a snap action. At the same time, the ceiling of the cover 4 comes into contact with the resilient tongue 24 of the locking member 3, and the reinforcing protuberances 31 of the cover 4 press the pivots 23 of the locking member 3 against the pivot supporting portions 15 so as to prevent the pivots 23 from accidental removal.

The thus described auto-lock slide fastener slider is suitable for use with a fastener chain having a pair of rows of coupling elements each mounted along an inner edge of each of a pair of fastener tapes, each row of the coupling element being of a discrete type or a meandering monofilament. In use, the locking pawl 26 enters a pair of opposite inter-coupling-element spaces of the fastener chain to automatically stop the slider.

FIG. 5 shows an auto-lock slide fastener slider according to a second embodiment which is substantially identical in structure with the slider of the previous embodiment. In the auto-lock slide fastener slider of FIG. 5, the slider body 1 has front and rear cover-attachment projections 12 each standing on the upper wing 7 and terminating in an outwardly directed hook 13 along only part of its width. Thus, the top of the cover-attachment projections 12 have projecting form with both side ends being cut off so as to be fitted in the cover 4.

The upper wing 7 has an engaging recess 14 near the base of the front cover-attaching projection 12, a pair of pivot supporting portions 15 disposed at opposite sides of the engaging recess 14 and projecting upwardly with their upper surfaces being concave and formed integrally with the front cover-attachment projection 12. And a rectangular locking-pawl-insertion hole 16 is provided near the base of the rear cover-attachment projection 12, and front and rear axle guide portions 17 disposed between the engaging recess 14 and the locking-pawl-insertion hole 16 and having confronting inclined surfaces. The front axle guide portions 17 are formed integral with the pivot supporting portions 15.

The pull tab 2 and the locking member 3 are identical in structure with those of the slider of the previous embodiment.

The pull tab 2 has a through-hole 18 at one end to form a ring-shape portion 19, an axle 20 and a grip portion 21 at the other end. The locking member 3 has at one end an engaging leg 22, a pair of transverse pivots 23 and a resilient tongue 24, and at the other end a locking pawl 26 projecting from a rear leg 25.

The cover 4 is in the form of an elongated bottomless box having a pair of axle-insertion holes 28 centrally in its opposite side walls 27 in which the axle 20 of the pull tab 2 is to be inserted, and a pair of inwardly directed hook portions 30 at the respective lower edges of front and rear end walls 29, the hook portions 30 being engageable with the corresponding hooks 13 of the front and rear cover-attachment projections 12. Also the cover 4 has a pair of reinforcing protuberances 31 bulging inwardly from the opposite side wells 27 along their upper corners for pressing the pivots 23 of the locking meeker 3 to prevent the pivots 23 from being removed off the pivot supporting portions 15. The individual parts of this slider are assembled in the same manner as in the previous embodiment.

FIG. 6 shows an auto-lock slide fastener slider according to a third embodiment. In the slider of the third embodiment, the slider body 1 has front and rear resilient cover-attachment projections 12 each standing on the upper surface of the upper wing 7 and terminating in an outwardly directed hook 13 along its entire width, each of said front and rear resilient cover-attachment projections 12 has a top surface 32 complementary to the inner shape of the cover 4 and shaped for supporting a leaf spring 5.

Further, the upper wing 7 of the slider body 1 has an engaging recess 14 near the base of the front cover-attachment projection 12, a stepped locking-pawl-insertion hole 16 near the base of the rear cover-attachment projection 12, and front and rear axle guide portions 17 disposed between the engaging recess 14 and the locking-pawl-insertion hole 16 and having confronting inclined guide surfaces, the rear axle guide portion 17 is divided into parallel halves so that the locking member 3 can be inserted between them.

The pull tab 2 has a form such that the axle 20 is provided at one end and can be placed between the axle guide portions 17. The locking member 3 is in the form of a generally C-shaped plate having at one end a front engaging leg 22 and at the other end a locking pawl 26 that is bent so as to match the shape of the stepped locking-pawl-insertion hole 16 for insertion in an inter-coupling-element space of one of opposite rows of coupling elements of the fastener chain.

Figure 7:
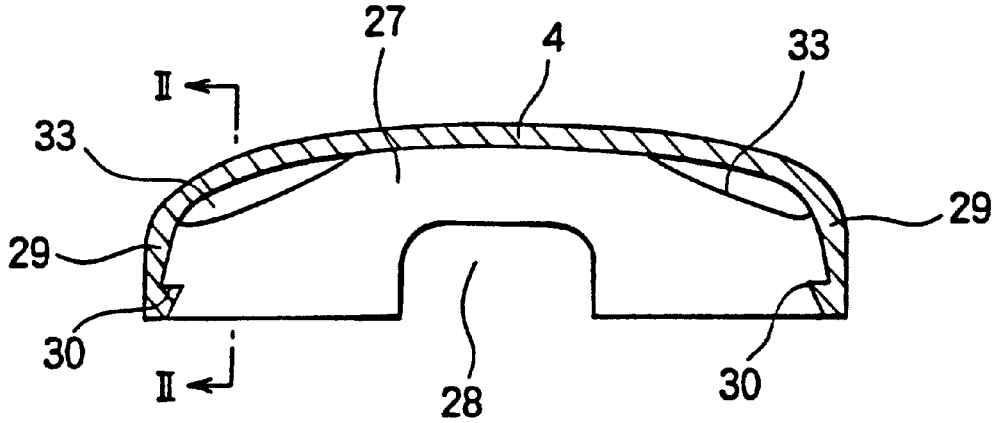
FIG. 7 is an enlarged longitudinal cross-sectional view of a cover of the slider of the third embodiment.
Figure 8:
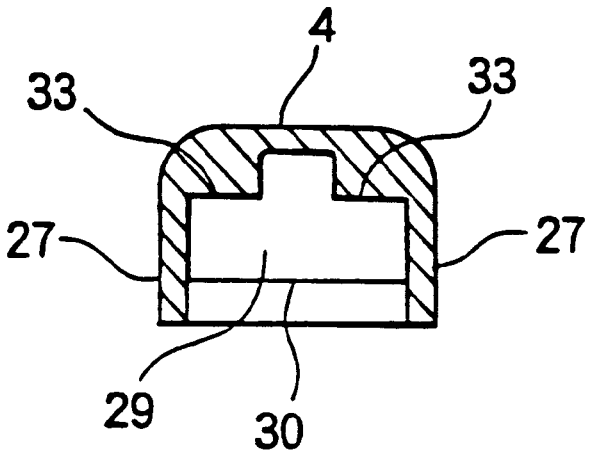
FIG. 8 is a transverse cross-sectional view taken along line II—II of FIG. 7.
Figure 9:
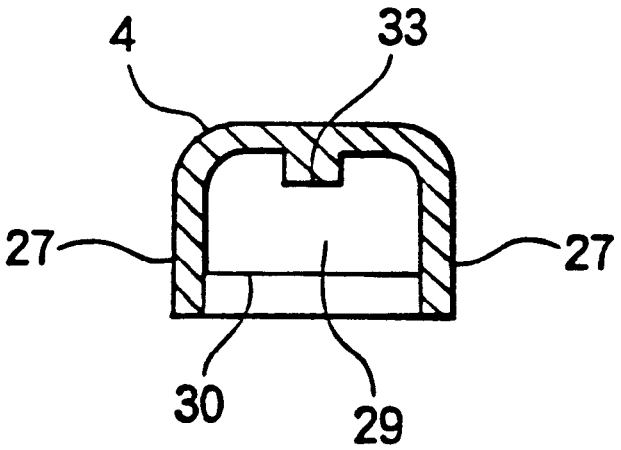
FIG. 9 is a transverse cross-sectional view similar to FIG. 8, but showing a modification of the cover.

The cover 4 is in the form of an elongated bottomless box having a pair of axle-insertion holes 28 centrally in its opposite side walls 27 for the axle 20 to be inserted therein and to be operable and a pair of projecting hook portions 30 at the respective lower inner edges of front and rear end walls 29 along their entire width, the hook portions 30 being engageable with the corresponding hooks 13 of the front and rear cover-attachment projections 12. Also the cover 4 has a pair of leaf-spring-holding protuberances 33 bulging inwardly from the opposite side walls 27 along their upper corners, as shown in FIGS. 7 and 8, for pressing opposite ends of the leaf spring 5 against the top of the front and rear cover-attachment projections 12. Alternatively, one leaf-spring-holding protuberance is provided centrally on an inner surface of an upper portion of the cover 4, as shown in FIG. 9. The leaf spring 5 is made of metal and has on each of the opposite ends an irregular surface 34 complementing the respective irregular top surface 32 of each of the front and rear cover-attachment projections 12 so as to be fitted in it.

For assembly, the pull tab 2 is placed flat on the upper wing 7 of the slider body 1 with the axle 20 supported between the front and rear axle guide portions 17 on the upper wing 7, and the locking member 3 is mounted astride of the axle 20 with the locking pawl 26 projecting into the coupling-element guide channel 11 from the locking-pawl-insertion hole 16, with the front engaging leg 22 received in the engaging recess 14, and the locking pawl 26 is inserted into the locking-pawl-insertion hole 16 as the locking member 3 is inserted between the rear axle guide portions 17, and then the leaf spring 5 is placed over the locking member 3 and supported between the front and rear cover-attachment projections 12, whereupon the cover 4 is pressed against the upper wing 7 of the slider body 1 so that the hooks 13 of the front and rear cover-attachment projections 12 resiliently engage with the hook portions 30 of the cover 4 in a snap action. At the same time, the leaf-spring-holding protuberances 33 of the cover 4 hold the opposite ends of the leaf spring 5 against the respective top irregular surfaces of the front and rear cover-attachment projections 12 so as to prevent the leaf spring 5 from accidental removal.

The thus described auto-lock slide fastener slider is suitable for use with a fastener chain having a pair of rows of coupling elements each sewn to or woven into an inner edge of each of a pair of fastener tapes, each raw of the coupling element being of a monofilament of synthetic resin such as polyamide and polyester wound in a coil. In use, the locking pawl 26 enters a pair of opposite inter-coupling-element spaces of the fastener chain to automatically stop the slider.

FIGS. 10 and 11 show double-sided auto-lock slide fastener sliders according to fourth and fifth embodiments. As shown in FIG. 10, the slider comprises a slider body 1 composed of upper and lower wings 7, 8 connected at their front ends by a guide post 9 and each having a pair of guide flanges 10 along opposite side edges, and front and rear resilient cover attachment projections 12 standing on each of the upper and lower wings 7, 8.

The slider body 1 has a through-hole 35 extending through the guide post 9 from the base of the front cover-attachment projection 12 on the upper wing 7 to the base of the front cover-attachment projection 12 on the lower wing 8, upper and lower pairs of pivot supporting portions 15 disposed one pair on opposite sides of each of upper and lower ends of the through-hole 35, a rectangular locking-pawl-insertion hole 16 disposed near the base of the rear cover-attachment projection 12 and extending through the upper wing 7, an engaging recess 36 near the rear cover-attachment projection 12 on the lower wing 8, and upper and lower pairs of axle guide portions 17 disposed, respectively, between the through-hole 35 and the locking-pawl-insertion hole 16 and between the through-hole 35 and the engaging recess 36 and each pair having confronting inclined guide surfaces, each of the pair of front axle guide portion 17 being formed integrally of the corresponding pivot supporting portions 15 on the respective wing 7, 8.

Also the slider includes a locking member 3 in the form of a generally C-shape plate having a front engaging leg 22 at one end, a pair of transverse pivots 23 projecting in opposite directions from opposite side surfaces of the plate near the base of the front engaging leg 22, an inwardly inclined resilient tongue 24 projecting from an upper surface of the plate, and a locking pawl 26 at the other end. The front engaging leg 22 has an inwardly inclined outer surface sloping toward its distal end.

In addition, the slider includes a link 6 in the form of a generally C-shape plate having at one end a front transmission leg 37, at the other end a rear engaging leg 38 received in the engaging recess 36 of the lower wing 8, and at an intermediate position near the base of the front transmission leg 37 a pair of transverse pivots 23 extending from opposite side surfaces of the plate. The front transmission leg 37 has an outwardly inclined inner surface sloping toward its distal end and engageable with the inclined outer surface of the front engaging leg 22.

Further, the slider has upper and lower covers 4 each being in the form of an elongated bottomless box having a pair of axle-insertion holes 28 centrally in its opposite side walls 27 and a pair of projecting hook portions 30 at the respective lower inner edges of front and rear end walls 29, along their entire width, the hook portions 30 being engageable with the corresponding hooks 13 of the front and rear cover-attachment projections 12. Also each cover 4 has a pair of reinforcing protuberances 31 bulging inwardly from the opposite side walls 27 along their upper corners for pressing the pivots 23 of the locking member 3 or the pivots 23 of the link 6 to prevent the pivots 23 from being removed off the pivot supporting portions 15 on the upper wing 7 or the lower wing 8.

For assembly, with the upper pull tab 2 and the locking remember 3 placed on the upper wing 7 of the slider body 1, the upper cover 4 is placed over them so as to engage the hook portions 30 with hooks 13 of the front and rear cover-attachment projections 12 of the upper pair. Then, the axle 20 of the lower pull tab 2 is placed between the lower pair of axle guide portions 17 on the lower wing 8, and the link 6 is placed astride of the axle 20 of the lower pull tab 2 with the rear engaging leg 38 received in the engaging recess 36 in the lower wing 8 and with the pivots 23 received in the pivot supporting portions 15 of the lower pair and with the front transmission leg 37 inserted in the through-hole 35 to engage with the inclined outer surface of the front engaging leg 22 of the locking member 3, whereupon the lower cover 4 is placed over them so as to engage the hook portions 30 with the hooks 13 of the front and rear cover-attachment projections 12 of the lower pair.

The double-sided slider of FIG. 11 is substantially identical in structure with the double-sided slider of FIG. 10 except that the shape of the locking member 3 to be plaid on the upper wing 7 of the slider body 1 and that a leaf spring 5 is used.

The upper wing 7 has front and rear resilient cover-attachment projections 12 each standing on the wing 7 and terminating in an outwardly directed hook 13 along its entire width. Each cover-attachment projection 12 has an irregular top surface 32 for supporting one of opposite ends of a leaf spring 5. The slider body 1 has a through-hole 35 extending through a guide post 9 from the base of the front cover-attachment projection 12 on the upper wing 7 to the base of the front cover-attachment projection 12 on the lower wing 8, a rectangular stepped locking-pawl-insertion hole 16 disposed near the base of the rear cover-attachment projection 12 and extending through the upper wing 7, an engaging recess 36 near the rear cover-attachment projection 12 on the lower wing 8, and upper and lower pairs of axle guide portions 17 disposed, respectively, between the through-hole 35 and the locking-pawl-insertion hole 16 and between the through-hole 35 and the engaging recess 36 and each pair having confronting inclines guide surfaces.

The locking member 3 is in the form of a generally C-shaped plate having at one end a front engaging leg 22 having a tapered outer surface and at the other end a locking pawl 26 that is bent so as to match the shape of the stepped locking-pawl-insertion hole 16 for insertion in an inter-coupling-element space of one of opposite rows of coupling elements of the fastener chain. Each of the upper and lower covers 4 is in the form of an elongated bottomless box having a pair of axle-insertion holes 28 centrally in its opposite side walls 27 and a pair of inwardly directed hook portions 30 at the respective lower inner edges of front and rear end walls 29 along their entire width, hook portions 30 being engageable with the corresponding hooks 13 of the front and rear cover-attachment projections 12 on the respective wing 7, 8. Also the cover 4 has a pair of leaf-spring-holding protuberances 33 bulging inwardly from the opposite side walls 28 along their upper corners for pressing opposite ends of the respective leaf spring 5 against the top of the front and rear cover-attachment projections 12. Each leaf spring 5 is made of metal and has on each of the opposite ends an irregular surface 34 complementing the respective irregular top surface 32 of each of the front and rear cover-attachment projections 12 so as to be fitted in it. The link 6 is identical in structure with that of the slider of the previous slider of FIG. 10.

For assembly of the slider, with the upper-wing axle 20 placed between the axle guide portions 17 on the upper wing 7, the pull tab 2 is placed on the upper wing 7, and then the upper locking member 3 is placed astride of the upper-wing axle 20 with the locking pawl 26 inserted in the locking-pawl-insertion hole 16 and with the front engaging leg 22 inserted in the through-hole 35, whereupon the leaf spring 5 is placed over the locking member 3 and is supported between the front and rear cover-attachment projections 12 of the upper pair. Then the upper cover 4 is placed over them so as to engage the hook portions 30 with the hooks 13 of the front and rear cover-attachment projections 12 of the upper pair. Then with the lower-wing axle 20 placed between the axle guide portions 17 on the lower wing 8, the lower pull tab 2 is placed on the lower wing 8, and then the link 6 is placed astride of the lower-wing axle 20 with the rear engaging leg 38 received in the engaging recess 36, with the front transmission leg 37 inserted in the through-hole 35 and engaging with the inclined outer surface of the front engaging leg 22.

Figure 12:
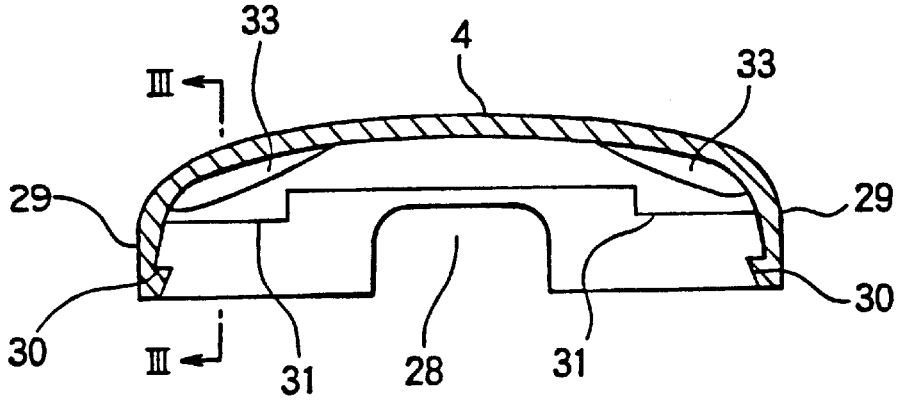
FIG. 12 is an enlarged longitudinal cross-sectional view showing a modification of the cover.
Figure 13:
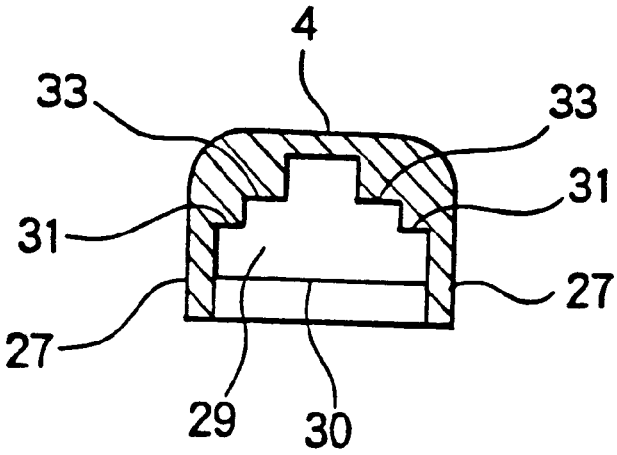
FIG. 13 is a transverse cross-sectional view taken along line III—III of FIG. 12.
Figure 14:
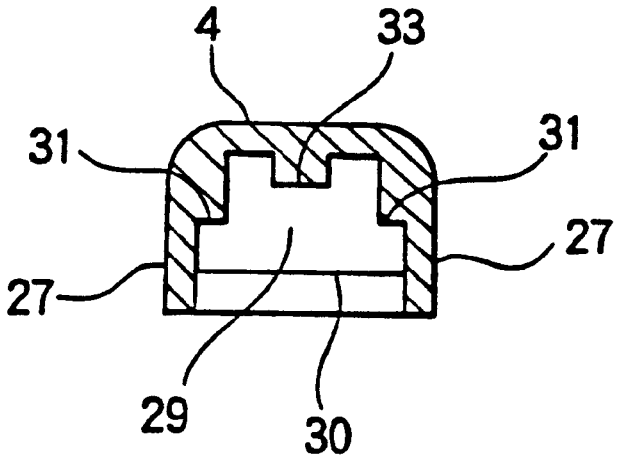
FIG. 14 is a traverse cross-sectional view similar to FIG. 13, but showing a modification of the cover of the fifth embodiment.

Each cover 4 of the double-sided slider may have both a pair of reinforcing protuberances 31 for pressing the pivots 23 and a pair of leaf-spring-holding protuberances 33 for holding the leaf spring 5, as shown in FIGS. 12, 13 and 14. In such a shape, the cover 4 may be used as either of upper and lower covers.

An apparatus for molding a cover of the auto-lock slide fastener slider will now be described.

The molding apparatus of FIGS. 15 through 19 comprises a movable die 40 and a fixed die 41. The movable die 40 has a stepped hole 42 in which a sliding template 44 having in its surface a cover-forming cavity 43 is slidably mounted. Springs 45 are disposed at a rear end of the sliding template 44, acting between the sliding template 44 and the movable die 40 to urge the sliding template 44 to project from the movable die 40. Between the movable die 40 and the sliding template 44, a pair of converging cams 46 is disposed one on each side of the sliding template 44.

A pair of slide cores 48 is mounted between the cams 46 fixed to the movable die 40, and is movable toward and away from each other in the cavity 43, each having in its upper outer surface an undercut recess 47 for forming half of hook portions of the cover. Also the opposed slide cores 48 have diverging inner surfaces 50, and each slide core 48 has a cam guide hole 49 converging to conform to the respective cam 46.

The fixed die 41 has in its contact surface recesses 51 in which the sliding cores 48 are slidable, and a pair of pressure pins 52 is mounted on the fixed die 41 one at each side of the recess 51 and is resiliently urged inwardly to normally press the outer surfaces of the slide cores 48 toward each other received in the recess 51. At the same time, the slide cores 48 are normally urged by springs 53, which are mounted on the bottom of the recess 51, so as to project to a constant extent.

Between the diverging inner surfaces 50 of the opposite slide cores 48, a tapered core 55 is inserted, having on its distal end an axle-insertion-hole-forming ridge 54. An ejector pin 56 is inserted centrally in the core 55 so as to be retracted and projected from the core 55 for ejecting the cover as a molded product. A cover-molding portion 48' of the slide cores 48 and the core 55 have on each of opposite side surfaces a composite stepped portion 57 for forming one of opposite reinforcing protuberances of the cover. Further, each of the slide cores 48 has in its upper surface a pair of recesses 58 for forming leaf-spring-holding protuberances which hold the cover. The stepped portions 57 and the recesses 58 may coexist with one another.

Figure 15:
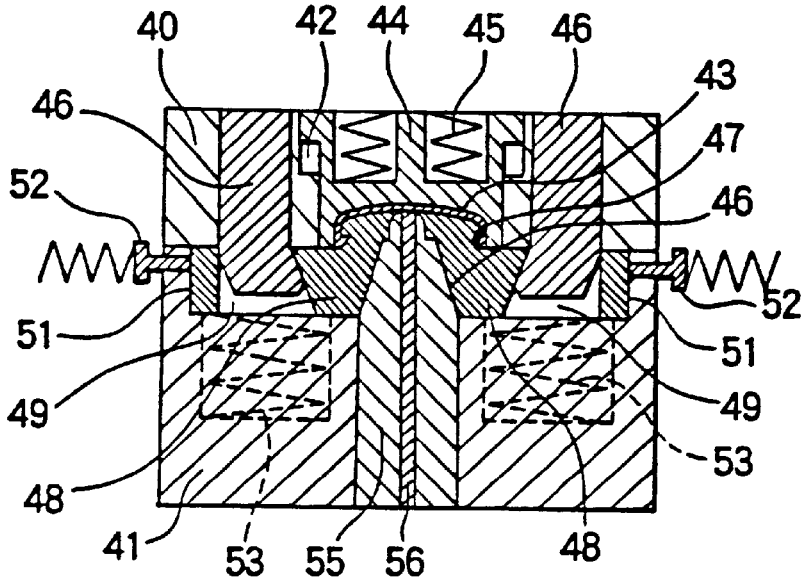
FIG. 15 is a cross-sectional view of an apparatus for molding a cover, during molding.

In the molding apparatus, when the movable die 40 is moved with respect to the fixed die 41 as shown in FIG. 15, the slide cores 48 are pressed against the recess 51 of the fixed die 41 against the resilience of the springs 53 by the movable die 40. At the same time, the slide cores 48 are moved outwardly by the tapered core 55 to push the opposite pressure pins 52 outwardly until the pressure pins 52 are fixed. Meanwhile, the slide cores 48 are brought into contact with the sliding template 44, which is disposed in the movable die 40, to retract the sliding template 44 against the springs 45 until the sliding template 44 is fixed.

With the movable die 40 thus fixedly held against the fixed die 41, thermoplastic resin is injected into the cavity 43 via a runner 59 and a gate 60 (FIG. 19) to mold the cover as a molded product.

Figure 16:
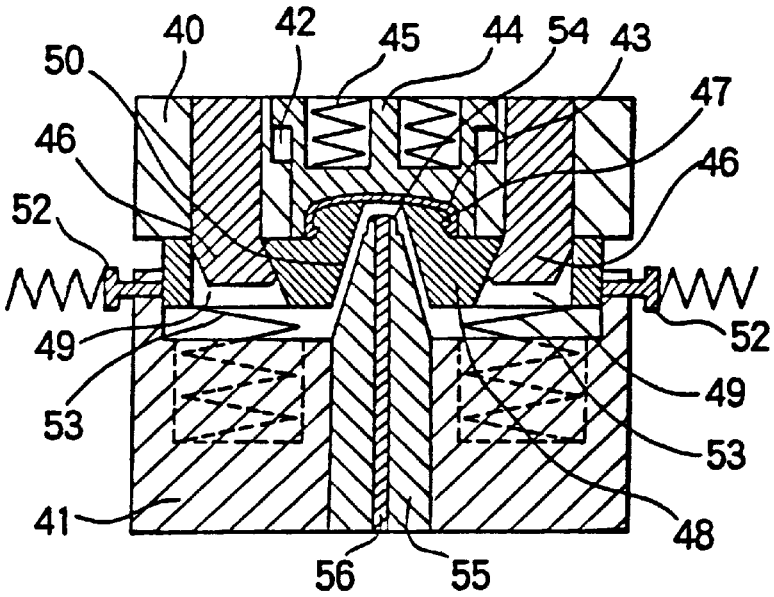
FIG. 16 is a cross-sectional view of the apparatus showing the molding apparatus when a movable die starts moving.
Figure 17:
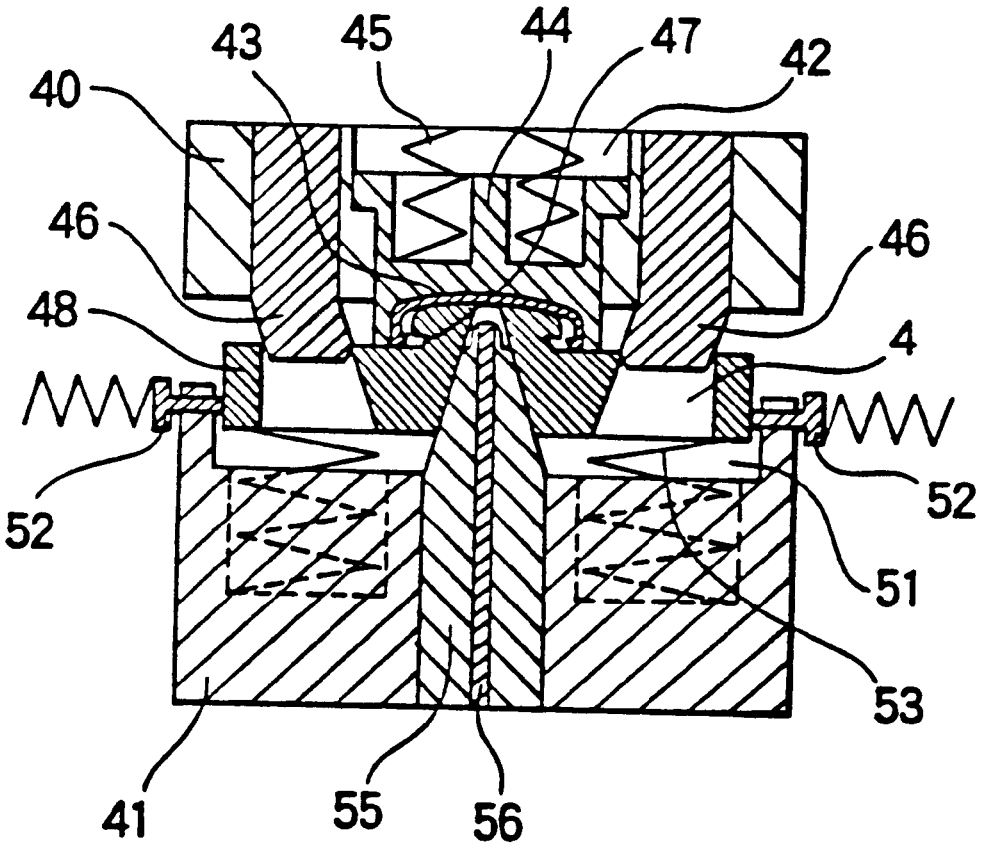
FIG. 17 is a cross-sectional view showing the molding apparatus when slide cores slide.

Upon termination of molding, the movable die 40 is retracted from the fixed die 41, and then the slide cores 48 are pushed toward the front side by the springs 53 disposed at the bottom of the recess 51 of the fixed die 41, as shown in FIG. 16. With continued retracting of the movable die 40, the cams 46 also are retracted, as shown in FIG. 17, so that the slide cores 48 are brought against the core 55 by the pressing action of the pressure pins 52 and, at the same time, the undercut recesses 47 are retracted in the cavity 43.

Figure 18:
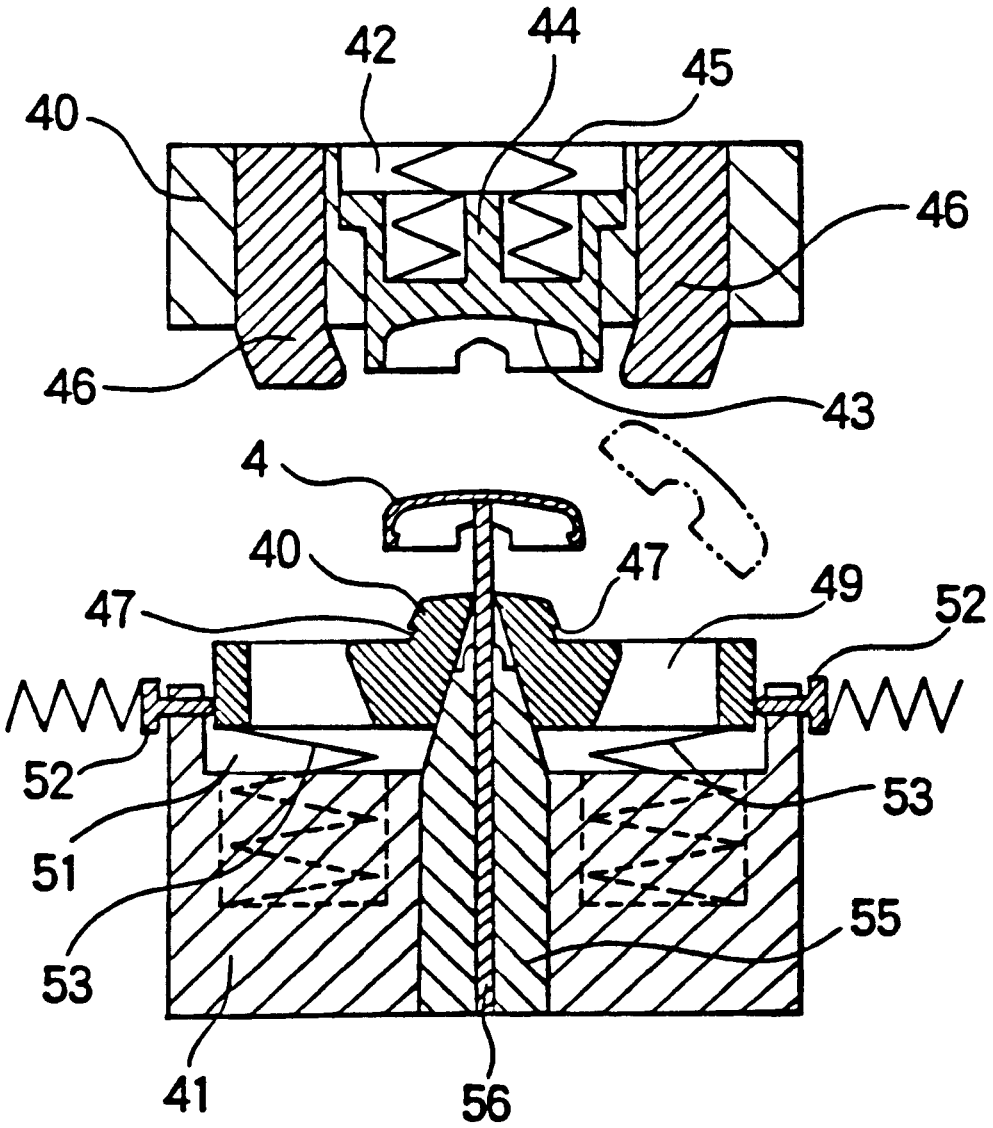
FIG. 18 is a cross-sectional view showing the molding die when the movable die has been moved all the way to the end of its stroke.
Figure 19:
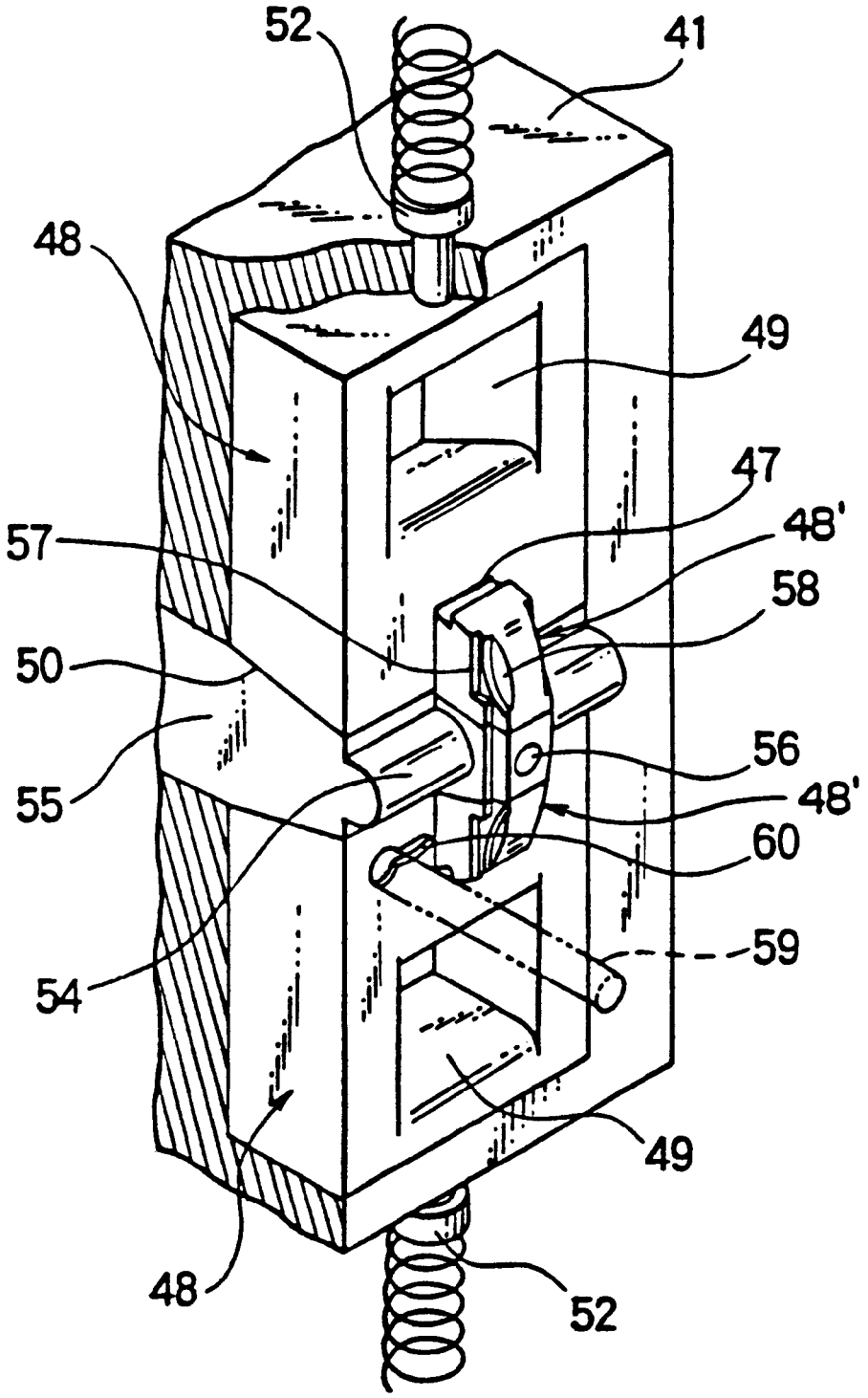
FIG. 19 is a fragmentary perspective view of a fixed die of the molding die.
Figure 20:
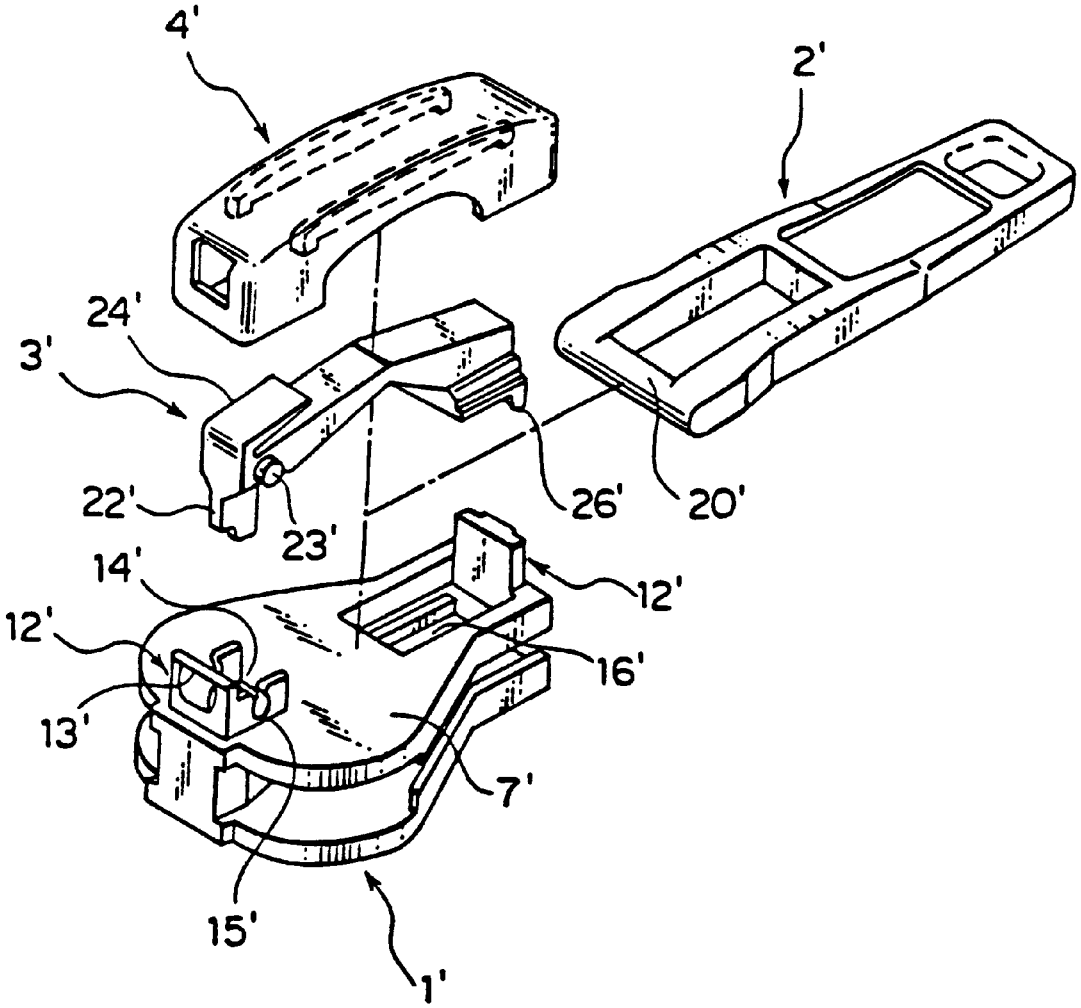
FIG. 20 (PRIOR ART)
FIG. 20 is an exploded perspective view of a conventional auto-lock slide fastener slider.

With still continued retracting of the movable die 40, the sliding template 44 also is forced to retract so that the slide cores 48 and the sliding template 44 are moved away from one another as shown in FIG. 18, whereupon the ejector pin 56 are projected front the core 55 to remove the cover from the molding die as a molded product. After this raving, the movable die 40 returns to its advanced position to co-operate with the fixed die 41 for the next molding. The arrangemet of movable die 40 and the fixed die 41 should by no means be limited to the illustrated example and may be reversed.

The auto-lock slide fastener slider and the apparatus for molding a cover of the auto-lock slide fastener slider have the following advantageous results:

According to the first aspect of this invention, partly since the thermoplastic resin slider body 1 has front and rear resilient cover-attachment projections 12 standing on the upper wing 7, which can be fitted in the cover 4 and have a pair of outwardly directed hooks 13, and partly since the thermoplastic resin cover 4 has a pair of inwardly directed hook portions 30 along the respective edges of front and rear end walls 29 for engagement with the corresponding outwardly directed hooks 13, it is possible to attach the resin cover 4 to the slider body 1 smoothly with maximum ease, thus facilitating assembly of the slider and improving the rate of production. Further, since the cover 4 has no through-holes unlike the conventional slider, it is possible to give the slider a neat appearance and to attach the cover 4 to the slider body 1 firmly without rattling during use so that durable sliders can be manufactured.

According to the second aspect of the invention, it is possible to assemble a four-member auto-lock slide fastener slider, which is composed of a slider body 1, a pull tab 2, a cover 4 and a locking member 3 having an inclined resilient tongue 24 integral with the locking member 3, simply and precisely, guaranteeing sufficient automatic locking function and neat appearance.

According to the third aspect of the invention, since the cover has a pair of reinforcing protuberances 31 bulging inwardly from its side walls 27 for pressing pivots 23 of the locking member 3, it is possible to reinforce the cover 4 and to hold the pivots 23 of the locking member 3 simply.

According to the fourth aspect of the invention, it is possible to assemble a five-member auto-lock slide fastener slider, which is composed of a slider body 1, a pull tab 2, a locking member 3, a leaf spring 5 and a cover 4, simply and precisely, guaranteeing sufficient automatic locking function and making the slider neat in appearance.

According to the fifth aspect of the invention, partly since each of front and rear cover-attachment projections 12 has on its top an irregular top surface 32 complementing the irregular surface 34 of each of opposite ends of a leaf spring 5, and partly since the cover 4 has a pair of leaf-spring-holding protuberances 33 bulging from its ceiling, it is possible to mount the leaf spring 5 on the slider body 1 simply and precisely and to mold the cover 4 that does not obstruct the action of the leaf spring 5.

According to the sixth aspect of the invention, it is possible to assemble a double-faced auto-lock slide fastener slider, which is composed of a slider body 1, upper and lower pull tabs 2, a locking member 3, a link 6 and upper and lower covers 4, with or without leaf springs, simply and precisely, guaranteeing the sufficient automatic locking function and making the slider neat in appearance.

According to the seventh aspect of the invention, it is possible to provide an apparatus for molding a thermoplastic cover, which has a neat appearance and is easy to be assembled, and can be attached to the slider body 1 readily and firmly by its hooking structure, simply and reliably by injection molding. Specifically, partly since the molding apparatus is divided into three parts and partly since the movable parts are forced to move by cams, it is possible to perform molding of covers reliably and efficiently without producing any defective products.

According to the eighth aspect of the invention, since the slide cores 48 have on each side a composite axle-holding-protuberance-forming stepped portion 57 and a pair of leaf-spring-holding-protuberance-forming recesses 58, it is possible to mold a cover 4, which has reinforcing protuberances 31 and leaf-spring-holding protuberances 33, reliably with a simple structure. Thus, the advantages brought by this invention are quite remarkable.

What is claimed is:

1. An apparatus for molding a cover of an auto-lock slide fastener slider, comprising:

(a) a fixed die;

(b) a movable die;

(c) a sliding template having a cover-forming cavity and resiliently projectable from said movable or fixed die;

(d) a pair of converging cams fixed to said movable or fixed die and projecting at opposite sides of said sliding template;

(e) a pair of slide cores laterally slidably received between said cams, each of said slide cores having in its upper outer surface an undercut recess, confronting surfaces of said slide cores being tapered;

(f) a tapered core fixed to said fixed or movable die between said confronting surfaces of said slide cores; and (g) an eject pin disposed centrally of said tapered core and projectable from said tapered core.

2. A molding apparatus according to claim 1, wherein each of said slide cores has a cover molding portion having on its upper side surface a stepped portion for forming reinforcing-protuberances so as to hold pivots, said tapered core having at its distal end an axle-insertion-hole-forming projection.

3. A molding apparatus according to claim 1, wherein each of said slide cores has a cover molding portion having in its upper surface a recess for forming a leaf-spring-holding protuberance so as to hold a leaf-spring, said tapered core having at its distal end an axle-insertion-hole-forming projection.

* * * * *

UNITED STATES PATENT AND TRADEMARK OFFICE

CERTIFICATE OF CORRECTION

PATENT NO. 6,109,908

DATED: August 29, 2000

INVENTORS: Hideshi IKEHARA et al.

It is certified that error appears in the above-identified patent and that said Letters Patent is hereby corrected as shown below:

On the Title Page, Item [57], in the Abstract, line 2, insert --member-- after "locking".

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*